US007426964B2

(12) United States Patent
Lynde et al.

(10) Patent No.: US 7,426,964 B2
(45) Date of Patent: Sep. 23, 2008

(54) RELEASE MECHANISM FOR DOWNHOLE TOOL

(75) Inventors: Gerald D. Lynde, Houston, TX (US); Tracey E. Tollefsbol, Houston, TX (US); Steve B. Wilson, III, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 311 days.

(21) Appl. No.: 11/021,917

(22) Filed: Dec. 22, 2004

(65) Prior Publication Data

US 2006/0131011 A1 Jun. 22, 2006

(51) Int. Cl.
*E21B 23/03* (2006.01)

(52) U.S. Cl. ..... 166/377; 166/123

(58) Field of Classification Search ..... 166/123, 166/182, 317, 377

See application file for complete search history.

(56) References Cited

U.S. PATENT DOCUMENTS

| | | | | |
|---|---|---|---|---|
| 2,937,854 | A | 5/1960 | Kinley et al. | |
| 3,429,595 | A | 2/1969 | McGill | |
| 4,984,632 | A | 1/1991 | Sampa et al. | |
| 5,119,875 | A | 6/1992 | Richard | |
| 5,526,888 | A | 6/1996 | Gazewood | |
| 5,718,291 | A | 2/1998 | Lorgen et al. | |
| 5,787,982 | A | 8/1998 | Bakke | |
| 5,960,884 | A | 10/1999 | Echols | |
| 5,984,029 | A | 11/1999 | Griffin et al. | |
| 6,053,250 | A | 4/2000 | Echols | |
| 6,053,262 | A | 4/2000 | Ferguson et al. | |
| 6,213,206 | B1 * | 4/2001 | Bakke | 166/242.7 |
| 6,318,470 | B1 | 11/2001 | Chang et al. | |
| 6,349,767 | B2 | 2/2002 | Gissler | |
| 6,382,323 | B1 | 5/2002 | Gano et al. | |
| 6,408,946 | B1 | 6/2002 | Marshall et al. | |
| 6,439,305 | B1 | 8/2002 | Bakke | |

(Continued)

FOREIGN PATENT DOCUMENTS

EP 1004745 A2 5/2000

(Continued)

OTHER PUBLICATIONS

Baker Oil Tools Catalog; Coiled Tubing Standard Tools; "Model FAU Safety Hydraulic Disconnect", 1 page, date unknown.

(Continued)

*Primary Examiner*—Jennifer H Gay
*Assistant Examiner*—Brad Harcourt
(74) *Attorney, Agent, or Firm*—Steve Rosenblatt

(57) ABSTRACT

A release mechanism for a downhole tool is actuated by radial movement of a locking member. The locking member provided as much as full circumferential support in the locked position and once released can be prevented from re-gripping the previously connected elements. Illustrative examples of the mechanism for radial movement for release comprise sleeves that expand and radially oriented pistons. Shear pins or collets are not used to hold the components together in the preferred embodiment. Internal pressure fluctuations before initiating the release sequence will not cause unwanted release. The mechanism is applicable to a variety of downhole tools and is illustrated in the context of a hydraulic release.

19 Claims, 4 Drawing Sheets

U.S. PATENT DOCUMENTS

Figure 1A:
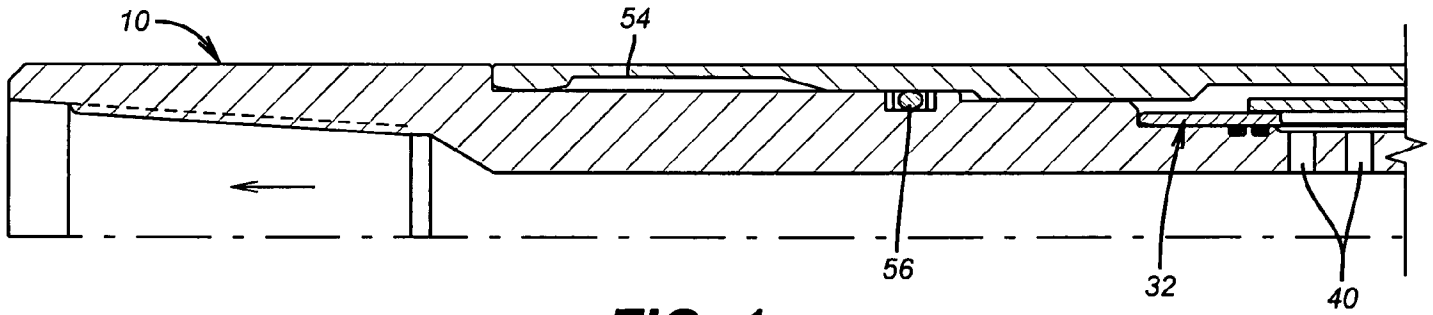

| | | | | |
|---|---|---|---|---|
| 6,527,048 | B1 | 3/2003 | Trosclair | |
| 6,629,563 | B2 * | 10/2003 | Doane | 166/125 |
| 6,719,046 | B2 * | 4/2004 | Mullins | 166/179 |
| 7,174,963 | B2 * | 2/2007 | Bertelsen | 166/376 |
| 2002/0162667 | A1 | 11/2002 | Ingram et al. | |
| 2003/0217844 | A1 | 11/2003 | Moyes | |
| 2004/0045704 | A1 | 3/2004 | Bowles | |

FOREIGN PATENT DOCUMENTS

| | | | |
|---|---|---|---|
| EP | 1004745 | A3 | 5/2000 |
| GB | 2333786 | A | 8/1999 |
| WO | WO 92/17679 | | 10/1992 |

OTHER PUBLICATIONS

Baker Oil Tools Catalog; Coiled Tubing Standard Tools; "High load Disconnect", 1 page, date unknown.

* cited by examiner

RELEASE MECHANISM FOR DOWNHOLE TOOL

FIELD OF THE INVENTION

The field of this invention is a release device for downhole tools that relies on expansion or radial movement to effect release of components previously held together.

BACKGROUND OF THE INVENTION

Downhole tool frequently involve mechanisms to hold one portion of the tool to another. This is sometimes accomplished using shearable members such as shear pins or similar devices such as spring loaded collets. Typically pistons are used with such locking elements to respond to built up pressure after landing a ball on a seat and adding pressure from above. Some of the problems with these designs lead to premature failure of the locking device creating a problem downhole. If the tool is a disconnect, for example, it may release prematurely forcing a fishing operation to retrieve the lowermost portion that falls in the wellbore. One of the reasons for the premature failure of the shear pins is the weight of the piston that has to ultimately move to break the shear pin or release a collet. Due to cyclical loading during run in or from operation of adjacent downhole equipment such as downhole pumps the shock loads on the piston combined with its weight can be sufficient to shear a pin or otherwise allow relative movement of tool components at an inopportune time.

Other limitations of prior designs is that the locking members that were used to hold the components fixed to each other provided only discrete areas of contact about the periphery of the components causing elevated stress levels due to the minimal contact areas and creating another weakness that has in the past lead to premature failure.

What is needed is a design to eliminate these premature failures with a design that does not become even more complex than the prior designs sought to be upgraded. The present invention offers solutions that meet this need. The shear pin or collet designs that were prone to failure in the past have been eliminated. In an embodiment of the invention locking components offer as much as 360 degree support to minimize shear failure. Unlocking is accomplished by radial movement of the locking members to release the grip between the members initially held together. Once the release is accomplished a lockout feature can be provided to prevent re-engagement. Radial movement can be accomplished in a variety of ways with pistons or a sleeve that bends responsive to applied internal pressure or by other mechanisms. The design that provides as much as full circumferential contact prior to unlocking can also take on a variety of forms. The application can be for a host of downhole tools although aspects of the preferred embodiment will be described in the context of a hydraulic release tool.

The prior art release tools that suffered from the limitations described above are represented by the following list of U.S. patents, presented as some examples of the issues affecting the prior art designs of hydraulic disconnects: U.S. Pat. Nos. 5,526,888; 6,527,048; 6,439,305; 6,408,946; 6,349,767; 6,318,470; 6,053,262; 6,053,250; 5,984,029; 5,960,884; 5,787,982; 5,718,291 and 4,984,632. Also of interest is U.S. Application 2004/0045704.

Those skilled in the art will appreciate the varied applications of the present invention and its advantages from a detailed discussion of two embodiments and the claims, which appear below.

SUMMARY OF THE INVENTION

A release mechanism for a downhole tool is actuated by radial movement of a locking member. The locking member provided as much as full circumferential support in the locked position and once released can be prevented from re-gripping the previously connected elements. Illustrative examples of the mechanism for radial movement for release comprise sleeves that expand and radially oriented pistons. Shear pins or collets are not used to hold the components together in the preferred embodiment. Internal pressure fluctuations before initiating the release sequence will not cause unwanted release. The mechanism is applicable to a variety of downhole tools and is illustrated in the context of a hydraulic release.

DETAILED DESCRIPTION OF THE DRAWINGS

Figure 2A:
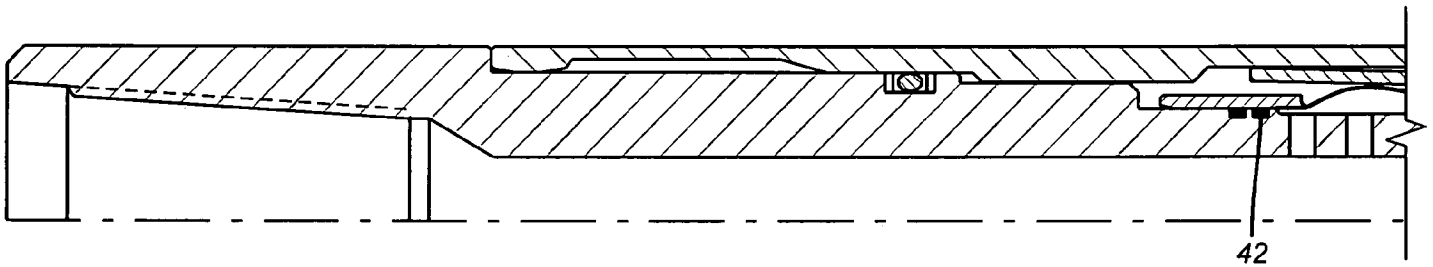
Figure 3A:
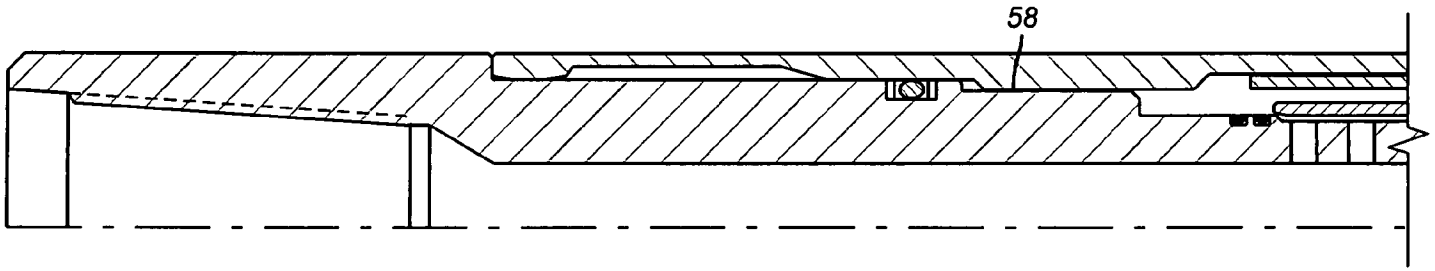
Figure 1B:
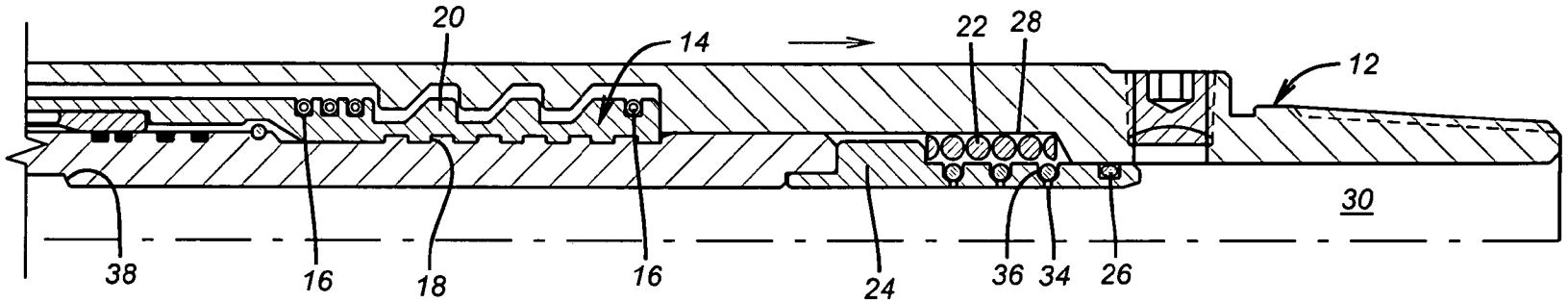
Figure 2B:
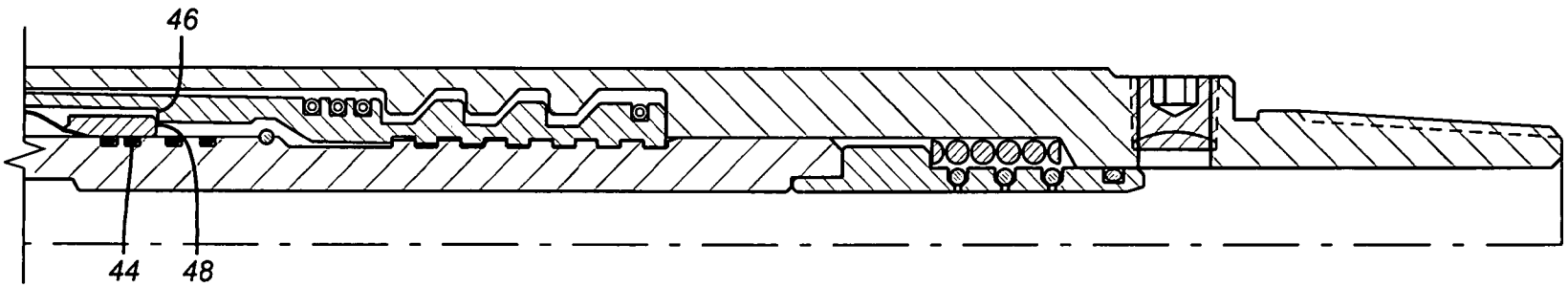
Figure 3B:
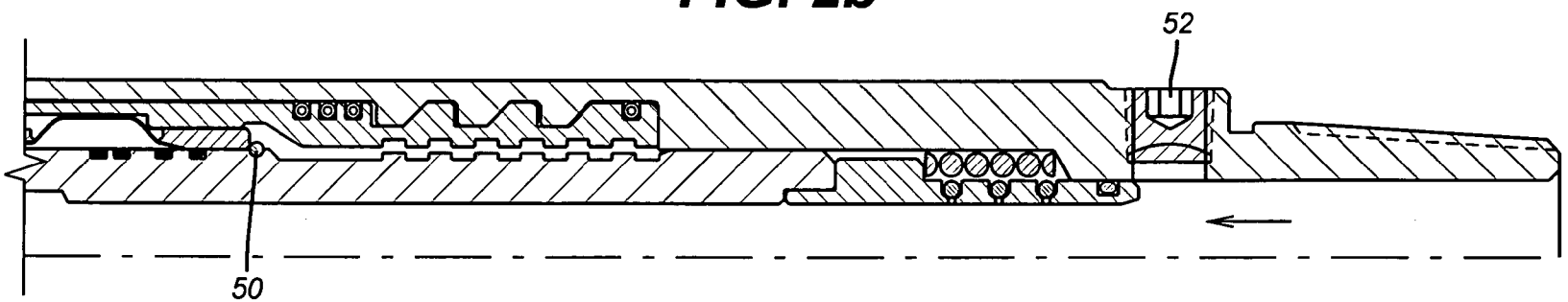
Figure 4A:
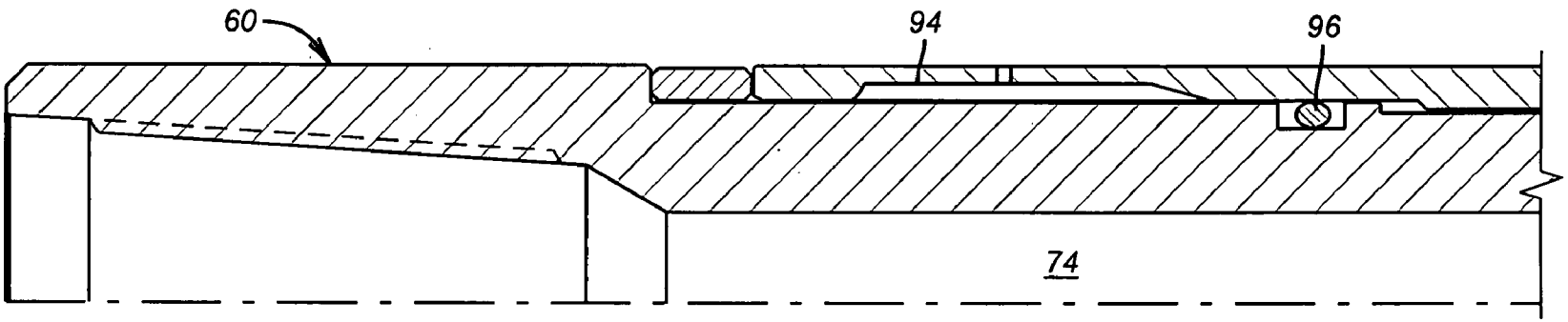
Figure 4B:
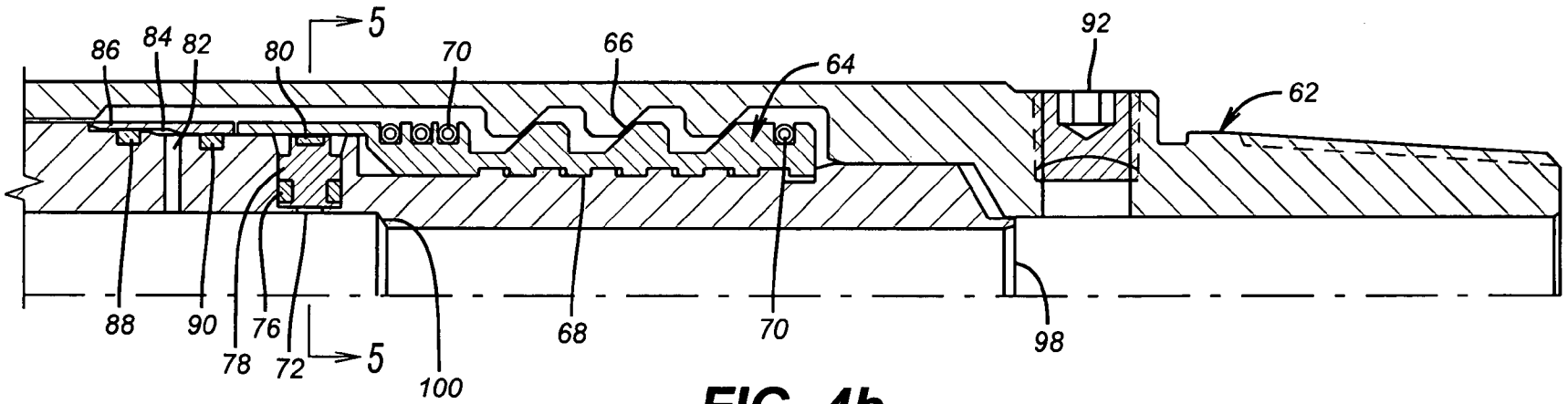
Figure 5:
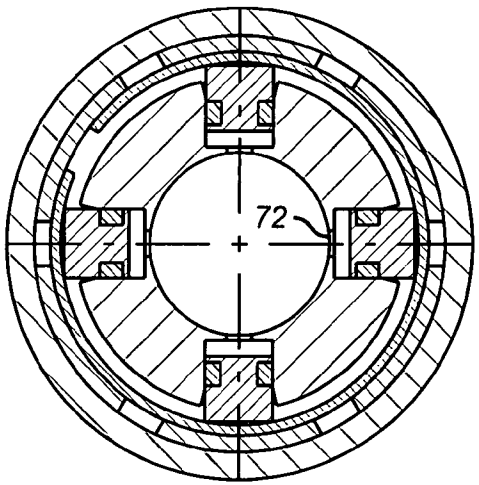

FIGS. 1*a*-1*b* show the run in position of the preferred embodiment in a half section view;

FIGS. 2*a*-2*b* are the view of FIGS. 1*a*-1*b* but in the beginning to release position;

FIGS. 3*a*-3*b* are the view of FIGS. 2*a*-2*b* but in the fully released position;

FIGS. 4*a*-4*b* are a half section view of an alternative embodiment in the run in position;

FIG. 5 is a section view along lines 5-5 of FIG. 4*b*.

DETAILED DESCRIPTION OF THE PREFERRED EMBODIMENT

Referring to FIGS. 1*a*-1*b*, the upper body 10 is secured releaseably to lower body 12 through locking ring 14. Preferably, locking ring 14 is made of segments that are held against the upper body 10 by band springs 16 or other biasing member or members. The number and placement of the band springs 16 is variable with the application. In the preferred embodiment the band springs 16 straddle the first projection-depression mating profile 18 that is disposed between the upper body 10 and the locking ring 14. A second projection-depression mating profile 20 is disposed between the locking ring 14 and the lower body 12. Profiles 18 and 20 can take a variety of configurations. Those skilled in the art will appreciate that the greater the number of undulations the smaller the shear load on each undulation. Similarly, the greater the height from valley to peak the smaller the shear load on each undulation. To the extent the locking ring 14 is in segment, the segments can take the full circumference for run in to reduce the shear load on each undulation. While the locking ring 14 is a complete sleeve that either expands for release or breaks into segments in response to a radial force, there again the shear load on each undulation is reduced. In fact, any form of locking profile that will resist shear loading can be used for profiles 18 and 20. To hold the profiles 18 and 20 together during run in and to prevent chatter that can cause premature wear, a spring 22 is supported off the lower body 12 to push against sleeve 24 that bears against the upper body 10. A wiper ring 26 prevents debris from reaching cavity 28 where spring 22 resides while letting pressure in passage 30 pass to the back side of expansion sleeve or actuator 32. Along the same lines one or more ports 34 are covered by a flexible ring 36 to handle pressure surges in passage 30 by lifting off ports 34 to equalize pressure on both sides of expansion sleeve 32.

Upper body 10 has a seat 38 to catch an object (not shown) to allow pressure buildup through ports 40. Upper seals 42 have preferably a greater diameter than lower seals 44 so that pressure directed through ports 40 bows out the sleeve 32, as shown in FIG. 2*a*. Since the upper end of the locking ring 14 overlays the expanding portion of sleeve 32, outward movement of sleeve 32 spreads apart profile 18 and narrows any gap in profile 20 with the result being release of the lower body 12 from the upper body 10. The locking ring 14 moves radially a sufficient distance so that a shoulder 46 moves away from shoulder 48 at the lower end of sleeve 32. Since the diameter of seals 42 is greater than seals 44 the pressure entering ports 40 puts a net downward force on sleeve 32 as well as pushing a part of it out to move the locking ring 14 radially outwardly. As soon as shoulder 46 clears shoulder 48 the net downward force moves sleeve 32 down until it lands on travel stop 50, as shown in FIG. 3*b*. In this position, the sleeve 32 prevents the locking ring 14 from moving radially inwardly to reconnect profile 18. In this preferred design, once release occurs the tool is prevented from reconnecting to the run in position.

It should be noted that a rupture disc or equivalent removable barrier 52 is used to open a circulation port if for any reason an emergency circulation path is needed prior to dropping the flow blockage device. A fishing neck 54 on the lower body 12 becomes exposed after tool separation to facilitate fishing out the lower body 12 and anything attached to it, if desired. Seal 56 keeps out annulus pressure and allows pressurizing into ports 40 when seat 38 is obstructed. One or more matched flats 58 can be provided where the lower body 12 overlaps upper body 10 to allow torque transmission through the tool when the components are attached as in the run in position shown in FIGS. 1*a*-1*b*.

In operation, the tool stays together until an object is dropped to obstruct seat 38. Pressure buildup in passages 40 flex the sleeve 32 radially outwardly to the point where locking ring 14 is forced radially outwardly as well. The profile 18 disengages and shoulder 46 moves radially and clear of shoulder 48 at the lower end of sleeve 32. A net force downwardly exists on sleeve 32 because the diameter of seals 42 exceeds the diameter of seals 44. As a result the sleeve 32 is forced under the now expanded locking ring 14 to prevent band springs 16 from reconnecting profile 18.

An alternative embodiment is shown in FIGS. 4 and 5. An upper body 60 is connected to a lower body 62 by a locking ring 64 that has a profile 66 to engage the lower body 62 and a profile 68 to engage the upper body 60. One or more band springs 70 bias the locking ring 64 inwardly closing the profile 68. At least one port 72 leads from passage 74 to a piston or actuator 76. Piston 76 has a seal ring 78 and a retainer 80 to hold it in a retracted position shown in FIG. 4*b*. Preferably retainer 80 is a flexible c-ring. Port 82 extends from passage 74 to annular space 84 sealed by locking sleeve 86 and seals 88 and 90. Due to the diameter of seal 88 being larger than the diameter of seal 90 a net downward force is applied to sleeve 86 from pressure in port 82. Pressure in port 72 pushes the piston 76 out against the force of the retainer 80 and forces the locking ring 64 radially outwardly to undo the profile 68 for a release. As that happens sleeve 86 is pushed down and under the locking ring 64 preventing it from moving back in radially.

Other features of this embodiment include a rupture plug or equivalent removable barrier 92 for the same purpose previously stated. A fishing neck 94 and a seal 96 to isolate annulus pressure. A passage 98 is for equalizing pressure surges in passage 74 across the piston 76. A seat 100 catches an object and allows pressure buildup in passages 72 and 82. A spring similar to 22 can also be employed in this embodiment for the same purpose.

Those skilled in the art will appreciate the wide application of the present invention to downhole tools of many types. The disadvantage of the prior designs featuring longitudinally shifting pistons that are movable after a shear or breakable element is removed and replaced with an actuating member that moves radially. The piston or actuating member does not need a restraint primarily because of its radial direction of movement. Longitudinal movement of the actuating member is simply precluded from the manner in which the parts are assembled. Pressure surges internally do not cause premature release because the actuator for release is pressure balanced and will not move until the desired time. The engagement between the components against shear forces tending to separate them can be a majority to as much as full 360 degree contact in one or multiple layers such that contact stresses in a particular location are minimized. Lower circumferential contact lengths are also envisioned. A positive lock feature is incorporated to prevent re-engagement of the components once they are released from each other. The radial movement of the actuating member can occur by expansion of a sleeve, radial movement of one or more pistons or by other equivalent structures. Because this movement is radial shock loading from running in and stopping is not an issue as the manner in which the parts are assembled and subsequently move prevents them from actuation under shock loading in an uphole or downhole direction.

While the preferred embodiment has been set forth above, those skilled in art will appreciate that the scope of the invention is significantly broader and as outlined in the claims which appear below.

We claim:

1. A releasable locking mechanism for a downhole tool having a longitudinal axis, comprising:

a first body;

a second body;

a lock discrete from said first and second bodies to selectively hold said first and second bodies together without a shearing member;

an actuator selectively movable radially with respect to said longitudinal axis and in contact with said lock, to operate said lock.

2. The mechanism of claim 1, wherein:

said actuator comprises at least one sleeve that expands.

3. The mechanism of claim 1, wherein:

said actuator comprises at least one piston.

4. The mechanism of claim 1, wherein:

said lock comprises an engagement profile to maintain contact with at least one of said first and second bodies for a majority of its circumferential dimension.

5. The mechanism of claim 1,further comprising:

a lockout for said lock to prevent said lock from holding said first and second bodies together after said actuator moves said lock.

6. The mechanism of claim 5, wherein:

said lockout is integral to said actuator.

7. The mechanism of claim 5, wherein:

said actuator comprises at least one piston;

said lock biased to maintain a first mating profile between itself and one of said bodies in contact;

said piston overcomes said bias with radial movement against said lock sufficient to disengage said first mating profile.

8. The mechanism of claim 7, wherein:

said first mating profiles maintain contact over a majority of the circumferential extent of said body with said profile.

9. The mechanism of claim 1, wherein:

said first and second bodies overlap and said lock is disposed between said bodies and further comprises opposed profiles to selectively engage mating profiles on said bodies.

10. The mechanism of claim 9, wherein:

said actuator selectively disengages one of said profiles to allow said bodies to move relatively.

11. The mechanism of claim 1, wherein:

said actuator is deformed radially to actuate said lock and thereafter retained by one of said bodies.

12. The mechanism of claim 1, wherein:

said lock comprises a unitary structure prior to radial displacement away from said longitudinal axis.

13. A releasable locking mechanism for a downhole tool having a longitudinal axis, comprising:

a first body;

a second body;

a lock to selectively hold said first and second bodies together without a shearing member;

an actuator selectively movable radially with respect to said longitudinal axis and in contact with said lock;

a lockout for said lock to prevent said lock from holding said first and second bodies together after said actuator moves said lock;

said actuator is hydraulically driven to flex radially to move said lock and to shift longitudinally under said lock after said lock is radially displaced.

14. A releasable locking mechanism for a downhole tool having a longitudinal axis, comprising:

a first body;

a second body;

a lock to selectively hold said first and second bodies together without a shearing member;

an actuator selectively movable radially with respect to said longitudinal axis and in contact with said lock;

said first and second bodies overlap and said lock is disposed between said bodies and further comprises opposed profiles to selectively engage mating profiles on said bodies;

said actuator selectively disengages one of said profiles to allow said bodies to move relatively;

said lock is biased radially toward the longitudinal axis and said actuator overcomes said bias when it moves radially.

15. A releasable locking mechanism for a downhole tool having a longitudinal axis, comprising:

a first body;

a second body;

a lock to selectively hold said first and second bodies together without a shearing member;

an actuator selectively movable radially with respect to said longitudinal axis and in contact with said lock;

a lockout for said lock to prevent said lock from holding said first and second bodies together after said actuator moves said lock;

a lockout longitudinally driven between one of said bodies and said lock when said actuator moves said lock radially.

16. The mechanism of claim 15, wherein:

said lockout and said actuator are driven by pressure applied from within said bodies.

17. A releasable locking mechanism for a downhole tool having a longitudinal axis, comprising:

a first body;

a second body;

a lock to selectively hold said first and second bodies together;

an actuator selectively movable radially with respect to said longitudinal axis and in contact with said lock;

a lockout for said lock to prevent said lock from holding said first and second bodies together after said actuator moves said lock;

said actuator comprises at least one piston;

said lock biased to maintain a first mating profile between itself and one of said bodies in contact;

said piston overcomes said bias with radial movement against said lock sufficient to disengage said first mating profile;

said lock and the other of said bodies further comprise a second mating profile disposed on the opposite side of said lock from said first mating profile, said second mating profile remaining engaged despite disengagement of said first mating profile resulting from movement of said piston;

said piston further comprises a bias toward said longitudinal axis that is overcome by hydraulic pressure from within a passage extending through said bodies.

18. A releasable locking mechanism for a downhole tool having a longitudinal axis, comprising:

a first body;

a second body;

a lock to selectively hold said first and second bodies together without a shearing member;

an actuator selectively movable radially with respect to said longitudinal axis and in contact with said lock;

said first and second bodies comprise a passage with at least one port to provide access to one side of said actuator and an additional port to provide access to an opposite side of said actuator to maintain said actuator in pressure balance, said passage comprising a seat between said ports to accept an object to block said passage for pressure buildup on one side of said actuator.

19. A releasable locking mechanism for a downhole tool having a longitudinal axis, comprising:

a first body;

a second body;

a lock to selectively hold said first and second bodies together without a shearing member;

an actuator selectively movable radially with respect to said longitudinal axis and in contact with said lock;

said lock is formed of segments biased toward said longitudinal axis.

* * * * *